US010703544B2

(12) United States Patent
Spivey et al.

(10) Patent No.: US 10,703,544 B2
(45) Date of Patent: Jul. 7, 2020

(54) TUMBLER LID

(71) Applicant: Base Brands, LLC, Atlanta, GA (US)

(72) Inventors: Patrick Spivey, Atlanta, GA (US); Kenneth Kreafle, Atlanta, GA (US)

(73) Assignee: Base Brands, LLC, Atlanta, GA (US)

( * ) Notice: Subject to any disclaimer, the term of this patent is extended or adjusted under 35 U.S.C. 154(b) by 114 days.

(21) Appl. No.: 16/006,678

(22) Filed: Jun. 12, 2018

(65) Prior Publication Data

US 2019/0375559 A1 Dec. 12, 2019

(51) Int. Cl.

*B65D 43/02* (2006.01)
*B65D 51/16* (2006.01)
*A47G 19/22* (2006.01)

(52) U.S. Cl.

CPC ..... *B65D 43/0229* (2013.01); *A47G 19/2266* (2013.01); *A47G 19/2272* (2013.01); *B65D 51/1611* (2013.01); *B65D 2231/022* (2013.01); *B65D 2543/005* (2013.01); *B65D 2543/00092* (2013.01); *B65D 2543/00231* (2013.01); *B65D 2543/00342* (2013.01); *B65D 2543/00546* (2013.01); *B65D 2543/00842* (2013.01); *B65D 2543/00972* (2013.01)

(58) Field of Classification Search

CPC ..... B65D 43/0229; B65D 51/1611; B65D 2231/022; B65D 2543/00342; B65D 2543/00546; B65D 2543/005; B65D 2543/00231; B65D 2543/00842; B65D 2543/00972; B65D 2543/00092; A47G 19/2266; A47G 19/2272

USPC ..... 220/521, 523, 709; 215/388

See application file for complete search history.

(56) References Cited

U.S. PATENT DOCUMENTS 2,772,034 A * 11/1956 Richmond, Jr. ..... F16N 3/08 222/341
4,074,827 A * 2/1978 Labe, III ..... B65D 51/28 206/217
5,180,079 A * 1/1993 Jeng ..... A47G 19/065 206/217
6,062,440 A * 5/2000 Murray ..... A01K 7/06 222/464.1
7,217,434 B1 * 5/2007 Loh ..... B65D 1/3205 206/217
2004/0089629 A1 * 5/2004 Villaescusa ..... A47G 19/2266 215/388
2006/0243725 A1 * 11/2006 Cha ..... B65D 1/265 220/4.27

(Continued)

*Primary Examiner* — James N Smalley

(74) *Attorney, Agent, or Firm* — Park, Vaughan, Fleming & Dowler LLP

(57) ABSTRACT

A lid for a drinking vessel is described. In one embodiment, the lid is an insulated lid configured to engage an opening of a container, where the lid is configured to at least partially retain the liquid within the container. The lid may further include a first opening for exposing the contents of the container to the atmosphere and for drinking from the container if desired. Additionally, the first opening may include an insert designed to reduce the heat transfer between the interior and exterior of the container, while in other embodiments aiding in the equalization of pressure between the interior and exterior of the container. Other aspects and embodiments of the present invention will be apparent from the following detailed description, drawings, and claims.

15 Claims, 8 Drawing Sheets

(56) References Cited

U.S. PATENT DOCUMENTS

| | | | | |
|---|---|---|---|---|
| 2012/0168440 | A1* | 7/2012 | Nerswick | B65D 47/06<br>220/212 |
| 2015/0001232 | A1* | 1/2015 | Chasin | A47G 19/2222<br>220/709 |
| 2016/0114959 | A1* | 4/2016 | Strominger | B65D 1/265<br>220/23.86 |
| 2018/0099805 | A1* | 4/2018 | Johnson | B65D 11/1866 |

* cited by examiner

TUMBLER LID

FIELD

This disclosure relates generally to drinking vessels and lids, and more specifically, to a lid for a tumbler.

BACKGROUND

Drinking vessels, such as cups, insulated beverage containers, canteens, and the like are used to contain fluids for drinking. Since fluids tend to spill if left in an open container, many drinking vessels include a lid. Some lids include openings for allowing controlled passage of the fluid to a user of the vessel. In some cases, the opening is a hole or slot for receiving a drinking straw. In other cases, the opening is a hole or slot for sipping directly through the lid. Various forms of such drinking vessels are known in the art. For example, paper disposable cups commonly include a plastic lid with an "X" shaped opening cut in the surface thereof for receiving a drinking straw. Many disposable coffee cups may be covered with a lid that includes a slot or spout for sipping directly through the lid. Such lids often include a secondary hole or opening for allowing passage of air through the lid, thereby equalizing the pressure inside the drinking vessel with the environment outside of the drinking vessel, as the liquid exits the vessel. Equalizing the pressure in this manner allows the fluid to more easily and smoothly exit the vessel.

Some drinking vessels are insulated to reduce thermal transfer between the fluid contained in the drinking vessel and the external environment. For example, some disposable coffee cups are formed of an insulating material, such as polymer foam. Other insulated drinking vessels may include an inner vessel and an outer shell, where at least a portion of the outer shell is spaced apart from a portion of the inner vessel. In some insulated drinking vessels, the space between the inner vessel and the outer shell is filled with air. In other cases the space may be filled with an insulating material, such as a fibrous material, a polymer foam material, or the like. In other cases, the space between the inner vessel and the outer shell is vacuum-sealed. Known drinking vessels are commonly made from paper, polymers, foam, plastic, metal, and the like.

People often use covered drinking vessels when they are on the move. For example, it may be desirable to cover a drinking vessel when transporting the fluid on foot or in a vehicle. Additionally, it may be desirable to use a covered drinking vessel in the outdoors to prevent contamination of the contained fluids by dirt, insects, or the like. It also may be desirable to cover a drinking vessel in order to further help keep its contents hot or cold, as the case may be.

As indicated above, it is known that by fully covering the vessel, its liquid contents are inhibited from pouring out through an established spout (or other opening) in the vessel due to backpressure exerted on the liquid inside the vessel. In other words, as fluid exits a covered vessel, the vacuum created by the exiting fluid causes pressure inside the vessel to drop below the pressure outside the vessel. This pressure differential causes air outside the vessel to flow through the spout and into the interior of the vessel until the pressure inside and outside the vessel reaches equilibrium. As this is taking place, the fluid inside the vessel is inhibited from exiting the vessel as quickly and/or as smoothly as it otherwise would if the internal and external pressures were the same. As indicated above, this is one reason for including a secondary hole or opening in the cover, i.e., it reduces the internal and external pressure differential and, therefore, allows the liquid to more freely escape from the vessel through the spout.

Unfortunately, prior art lids for drinking vessels do not adequately insulate the vessel's contents—whether hot or cold. In other words, lids on such vessels are a source of thermal transfer that leads to hot liquid (in the vessel) cooling too rapidly or cold liquids (in the vessel) warming too rapidly. In addition to other aspects of the design of such lids, drinking (or other) openings in the lids, as well as vents in the lids designed to equalize the internal and external pressure of the vessel, also can contribute to this undesirable heat transfer.

SUMMARY

Embodiments of systems and apparatuses including a drinking vessel lid are described. In one embodiment, the apparatus includes an insulated lid configured to engage an opening of a container, the lid configured to at least partially retain the liquid within the container. The apparatus may further include a first opening in the lid for exposing the contents of the vessel to the atmosphere and for drinking from the vessel if desired. Additionally, the first opening may include an insert designed to reduce the heat transfer between the interior and exterior of the drinking vessel, while in other embodiments aiding in the equalization of pressure between the interior and exterior of the drinking vessel. Other aspects and embodiments of the present invention will be apparent from the following detailed description, drawings, and claims.

BRIEF DESCRIPTION

The following drawings form part of the present specification and are included to further demonstrate certain aspects of the present invention. The invention may be better understood by reference to one or more of these drawings in combination with the detailed description of specific embodiments presented herein.

Figure 8:
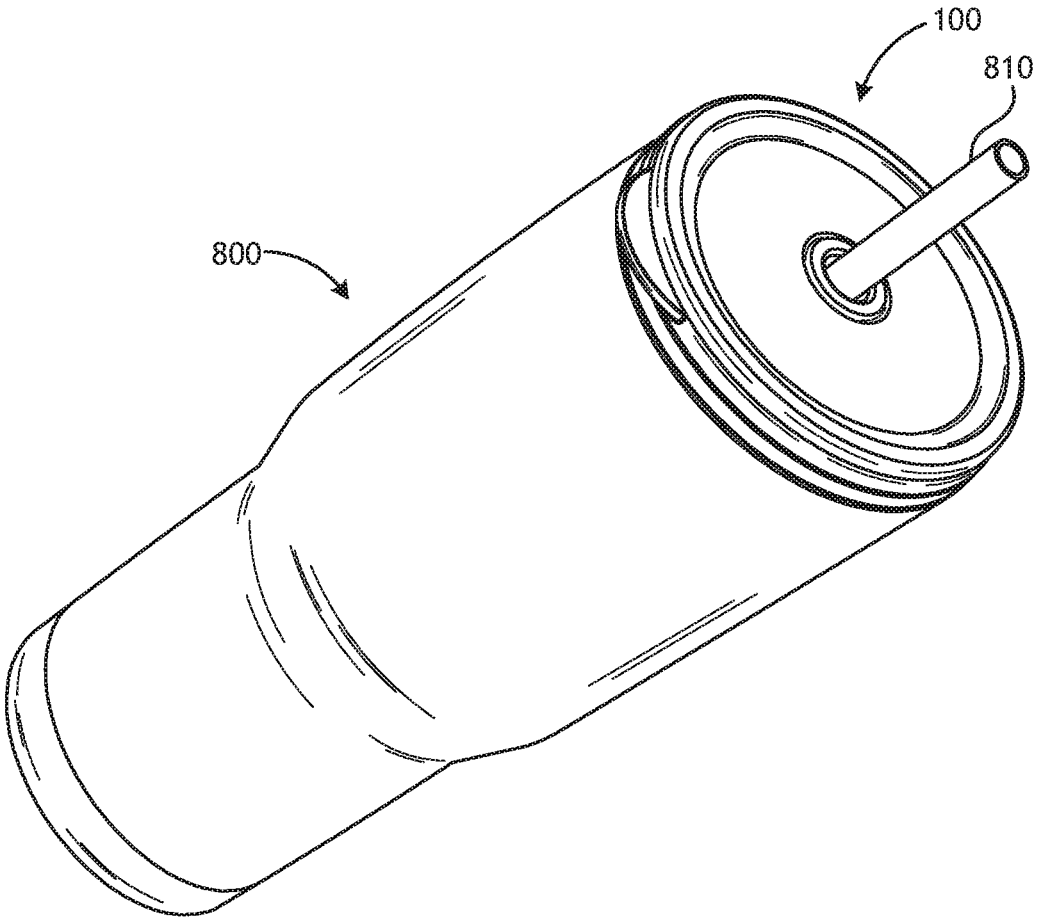

FIG. 8 a top perspective view diagram of one embodiment of a lid with a drinking vessel and straw.

DETAILED DESCRIPTION

Various features and advantageous details are explained more fully with reference to non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The present embodiments describe a lid for a drinking vessel, as well as the drinking vessel itself. For example, in one embodiment, the lid may be a lid for a tumbler style cup. The tumbler may be formed of stainless steel sheet metal. The drinking vessel may include an inner vessel and an outer shell where at least a portion of the inner vessel is spaced apart from the outer shell, and wherein a space between the inner vessel and the outer shell is vacuum-sealed.

In one embodiment, the drinking vessel or container can be configured to receive a lid. Other embodiments include only the lid. In one embodiment, the lid is insulated and further configured to engage an opening of its corresponding container, such that the lid is configured to at least partially retain the liquid within the container. The lid may further include a first opening for exposing the contents of the container to the atmosphere and/or for drinking from the container if desired. Drinking from the container, through the lid and/or its first opening, can be accomplished using a straw or otherwise. Additionally, in an embodiment, the first opening may include an insert designed to reduce the heat transfer between the interior and exterior of the container, while in other embodiments aiding in the equalization of pressure between the interior and exterior of the container. In other embodiments, the lid may include a seal for more securely sealing the lid to the container, so that any liquid in the container is less likely to escape from the region where the lid joins the container. Likewise, in yet another embodiment, the lid may include a rim for more easily attaching or detaching the lid from the container.

Various other non-limiting embodiments are described below.

Figure 1:
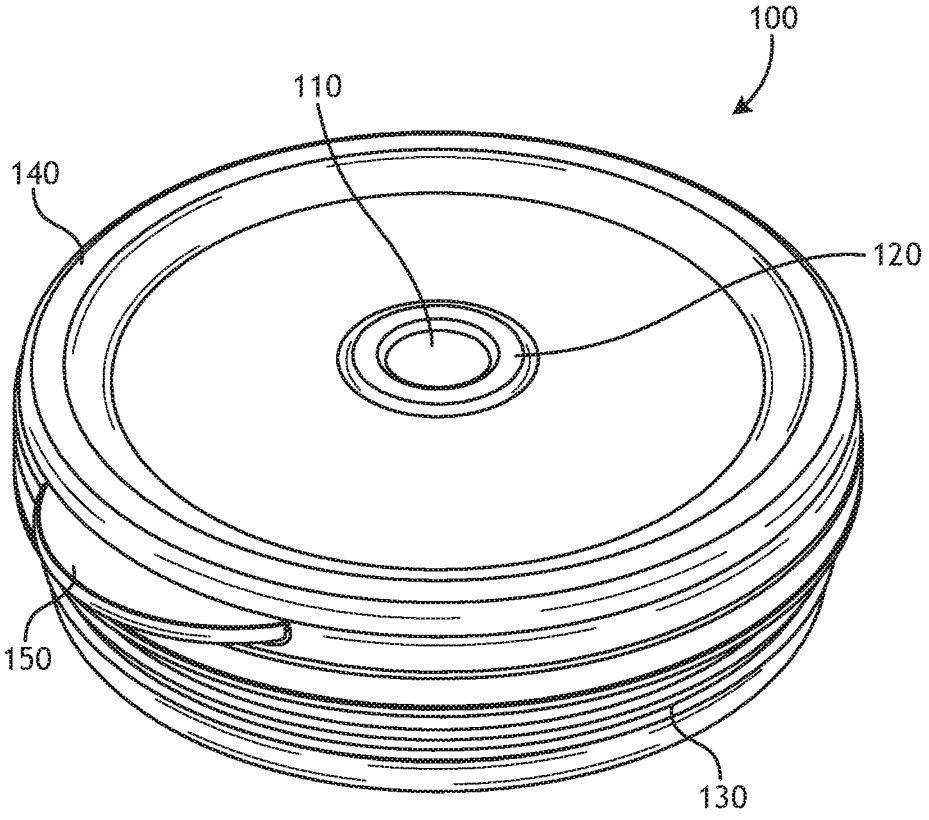
FIG. 1 is a top perspective view diagram of one embodiment of a lid.

FIG. 1 is a top perspective view diagram of one embodiment of a lid 100 for a drinking vessel. In an embodiment, the lid 100 may engage an interior surface of a drinking vessel (not shown) when seated. In another embodiment, the lid 100 may engage an exterior surface of the drinking vessel when seated. Beneficially, the lid 100 may contain (or help keep) a fluid within its associated drinking vessel. The lid and/or the vessel may be insulated to reduce thermal conduction between a fluid contained therein and the external environment. For example, the vessel may be a stainless steel vacuum insulated tumbler. Other configurations, shapes, and sizes of the vessel also are possible. An exemplary vessel is shown in FIG. 8.

Other features of this particular embodiment of the lid 100 are further described by FIG. 1. For example, lid 100 may include a top portion (see also FIG. 3) and a bottom portion (see also FIG. 4), where the top portion and the bottom portion of the lid are separated from one another to form an enclosed region (see also FIG. 6), i.e., a region that is not exposed to the outside atmosphere. As such, the enclosed region forms an insulation layer between the outside environment and the contents of a drinking vessel associated with the lid. As indicated, such an insulation layer reduces thermal conduction between a vessel's contents and the external environment.

The lid 100 also may include a first opening 110 for exposing the contents of the drinking vessel to the atmosphere and for drinking from the vessel if desired. In an embodiment, such as that further described by FIG. 6, the first opening extends through the top portion and the bottom portion of the lid but does not expose the enclosed region of the lid to atmospheric conditions, thereby maintaining the described insulation layer between the outside environment and the contents of a drinking vessel associated with the lid. Drinking from the vessel, through its first opening 110, can be accomplished using a straw (not shown) or otherwise. Additionally, in this embodiment, the first opening 110 may include an insert 120 designed to reduce the heat transfer between the interior and exterior of the vessel, while in other embodiments aiding in the equalization of pressure between the interior and exterior of the vessel. Insert 120 may be a component formed in conjunction (i.e., molded or fabricated) with the lid 100, or it may be a separate component that is installed in the first opening 110 after the lid has been otherwise fabricated.

The lid 100 also may include a seal 130 for more securely sealing the lid to its corresponding vessel, so that any liquid in the vessel is less likely to escape from the region where the lid joins the vessel. The lid 100 may include a raised rim 140 for retaining any small amounts of liquid that may inadvertently spill from the vessel. Affiliated with the rim 140 is a tab 150, which can be used to more easily attach or detach the lid 100 from its associated vessel. Indeed, tab 150 can be particularly useful in providing leverage when attaching the lid 100 to its associated vessel since the lid is sized to fit snuggly with its associated vessel, and particularly so when seal 130 is employed.

Figure 2:
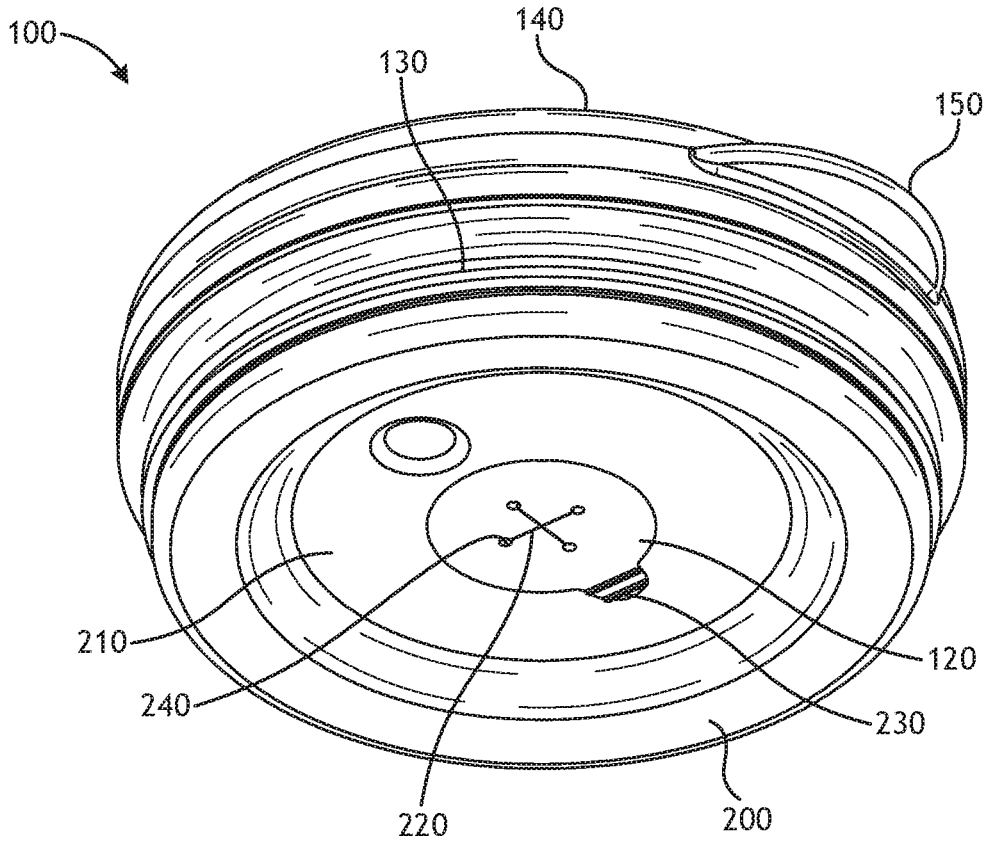
FIG. 2 is a bottom perspective view diagram of one embodiment of a lid.

FIG. 2 is a bottom perspective view diagram of one embodiment of a lid 100 for a drinking vessel. In this embodiment, the lid 100 includes features described above with respect to the embodiment of FIG. 1, namely insert 120, seal 130, rim 140, and tab 150. Note that insert 120 (here shown from the bottom perspective view of the lid 100) further includes a preferred shape and structure, namely a flat bottom that smoothly and securely mates with the underside 210 of the lid 100. In this embodiment, insert 120 further preferably includes a semi spill-proof opening 220 through which a straw or other drinking or sipping implement can pass for accessing the contents of the associated drinking vessel. In this particular embodiment, the semi spill-proof opening 220 is a crosshatch slit in insert 120, but other such openings are within the spirit of the present invention. Likewise, in this embodiment, the semi spill-proof opening is shown as being located at the bottom of insert 120, but it should be noted that the semi spill-proof opening could be located at the top of insert 120, or anywhere between the top and bottom of insert 120.

Still further, insert 120 is shown in this embodiment as also including four small air vents 240, one each at the terminating point of the crosshatch slit in insert 120. Other positions, sizes, and shapes of air vents are within the spirit of the present invention, but each serves to assist in equalizing the pressure inside and outside the vessel associated with the lid 100. In this embodiment, insert 120 also includes tab 230 for better grasping insert 120 when inserting, removing, or cleaning insert 120. Finally, the particular embodiment of FIG. 2 also shows that the bottom or lowest surface of the lid 100 includes a raised rim 200. The underside 210 of the lid 100 is recessed from the rim 200 so as to provide a substantially equally recessed surface for insert 120. Recessing underside 210 from the rim 200 assists in ensuring that the liquid contents of the associated drinking vessel are less likely to spill or leak through insert 120.

Figure 3:
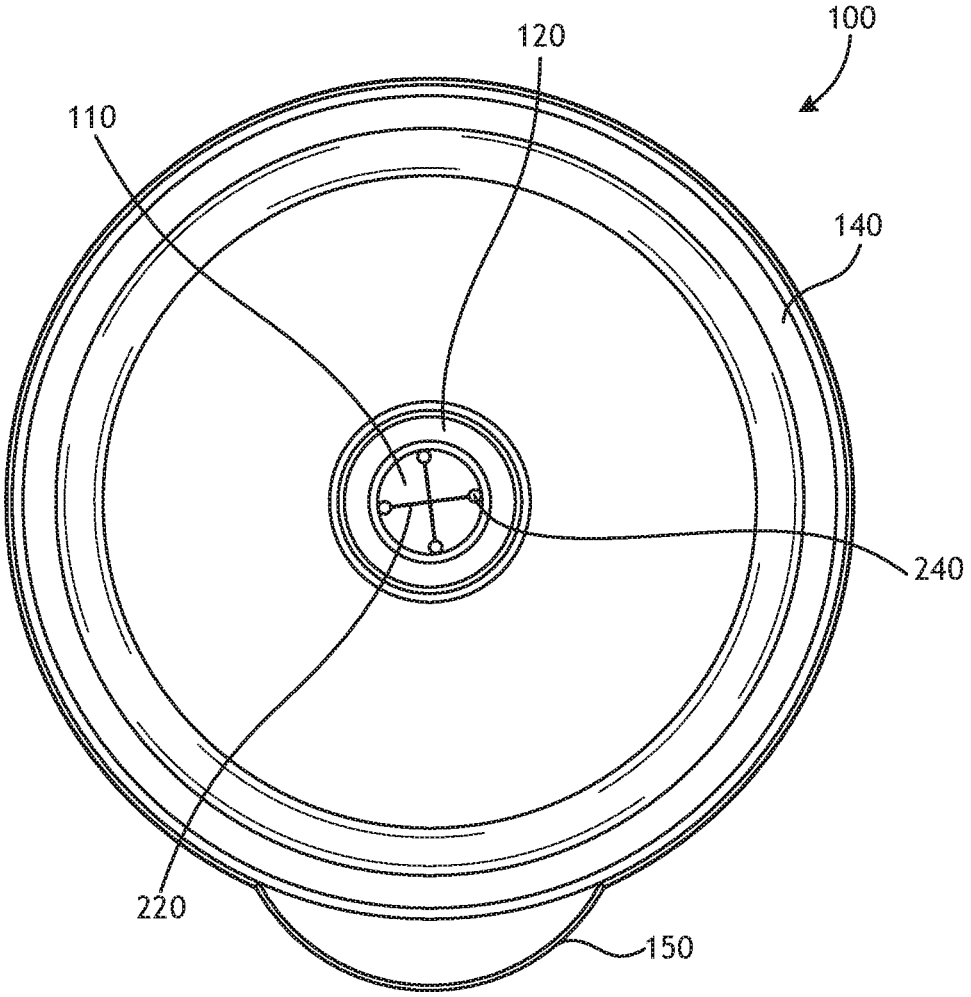
FIG. 3 is a top view diagram of one embodiment of a lid.

FIG. 3 is a top view diagram of an embodiment of a lid 100. In this embodiment, the lid 100 includes features described above with respect to the embodiments of FIGS. 1-2, namely first opening 110, insert 120, rim 140, tab 150, semi spill-proof opening 220 in insert 120, and air vents 240. Note that the embodiment of FIG. 3 also illustrates an embodiment of insert 120 as including four small air vents, one each at the terminating point of each crosshatch slit in insert 120. Again, other positions, sizes, and shapes of air vents are within the spirit of the present invention, but each serves to assist in equalizing the pressure inside and outside the vessel associated with the lid 100. Likewise, embodiments of the present invention do not necessarily require such air vents since pressure inside and outside the associated vessel can equalize (or approach equalization) through only the communication between the inside and outside atmospheres provided by semi spill-roof opening 220.

Figure 4:
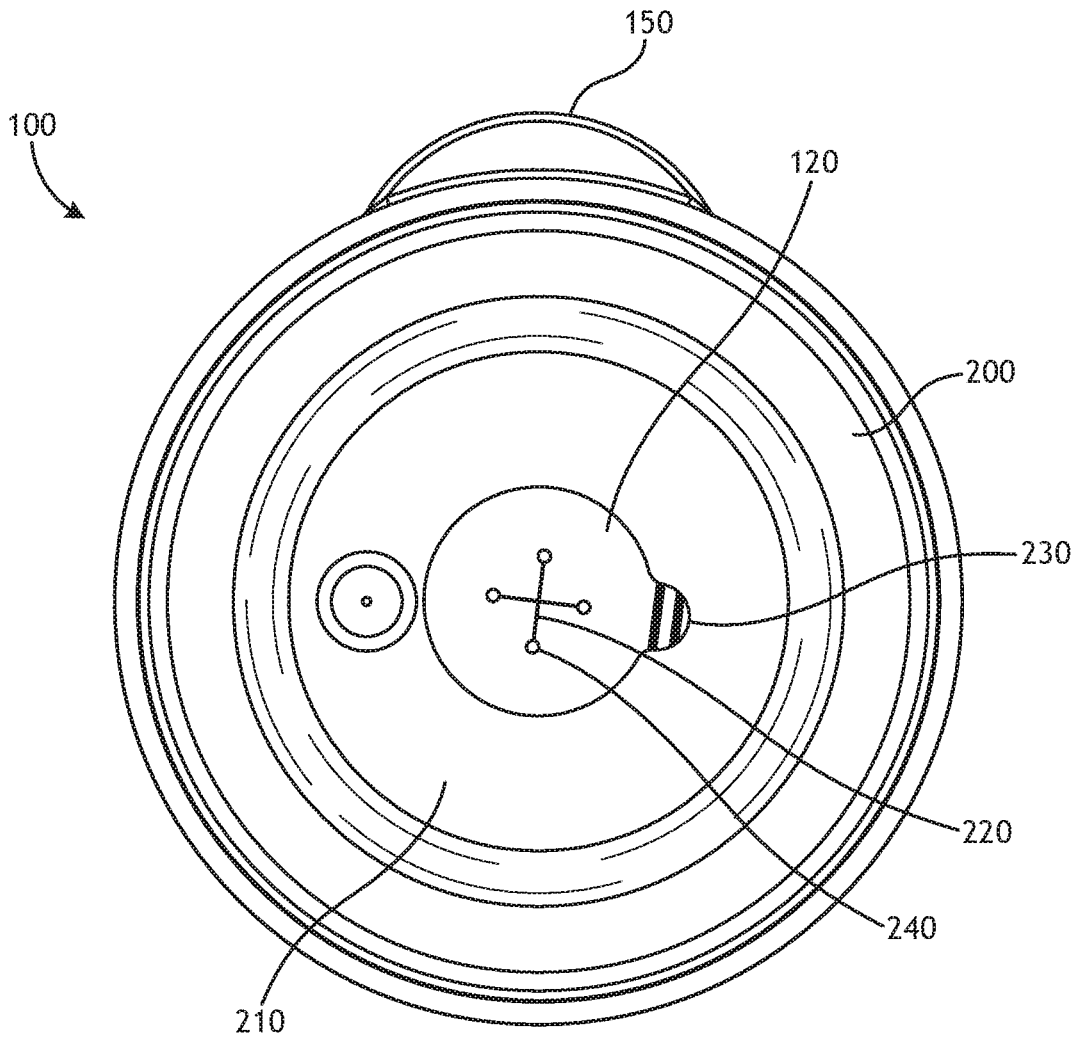
FIG. 4 is a bottom view diagram of one embodiment of a lid.

FIG. 4 is a bottom view diagram of an embodiment of a lid 100. In this embodiment, the lid 100 includes features described above with respect to the embodiments of FIGS. 1-3, namely insert 120, tab 150, rim 200, underside 210, semi spill-proof opening 220, tab 230, and air vents 240.

Figure 5:
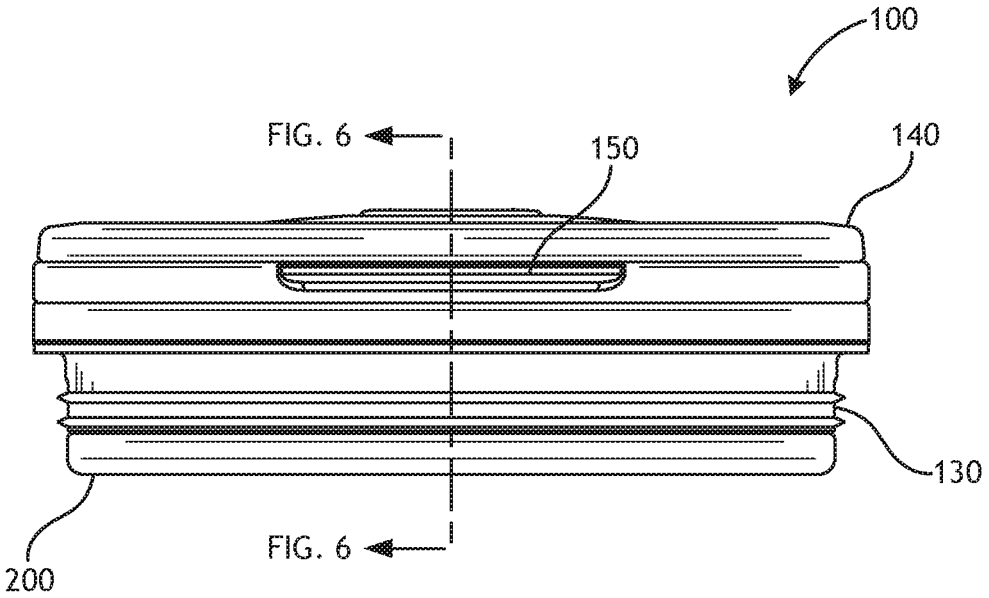
FIG. 5 is a side view diagram of one embodiment of a lid.

FIG. 5 is a side view diagram of an embodiment of a lid 100. In this embodiment, the lid 100 includes features described above with respect to the embodiments of FIGS. 1-4, namely seal 130, rim 140, tab 150, and rim 200. FIG. 5 also shows a cross section line 6-6.

Figure 6:
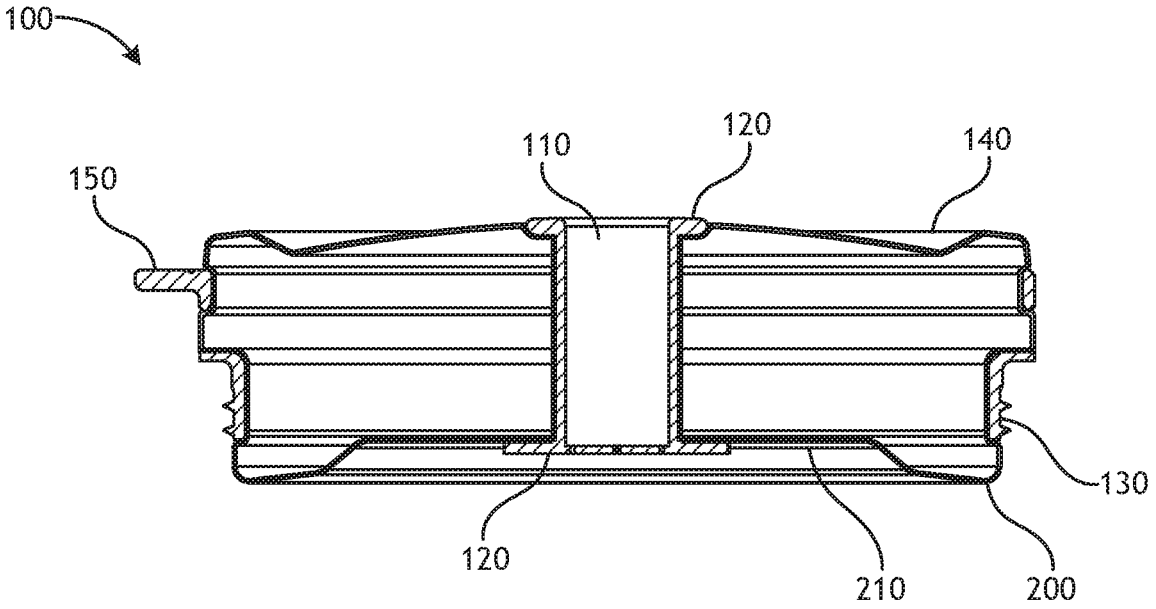
FIG. 6 is a cross section view diagram of one embodiment of a lid of FIG. 5.

FIG. 6 is a cross section view diagram of one embodiment of the lid shown in FIG. 5 taken along line 6-6 of FIG. 5. In this embodiment, the lid 100 includes features described above with respect to the embodiments of FIGS. 1-5, namely first opening 110, insert 120, seal 130, rim 140, tab 150, rim 200, and underside 210. FIG. 6 also shows an embodiment of insert 120 as providing a uniform passage through the first opening 110 of lid 100, which in this embodiment extends from the top, exterior of the lid 100, through the lid 100, and continuing through the bottom, exterior of the lid 100. As such, drinking from a container associated with the lid 100 is possible, either by sipping directly through the first opening in the lid as provided by insert 120, or by using a drinking implement such as a straw inserted through insert 120 and into the associated container.

FIG. 6 also shows further details of an embodiment of insert 120. While other embodiments are possible, this embodiment shows insert 120 as a unitary component that seats in the first opening 110 and is held in place by substantially conforming to the interior shape of first opening 110 and overlapping the surfaces of the lid 100 immediately adjacent the upper and lower surfaces of the first opening. In this preferred—but non-limiting—embodiment, insert 120 is made of pliable rubber such that it can be readily inserted or removed from the lid 100. Rubber is not only a good insulator, but its deformable properties allow a straw or other drinking implement to be readily inserted through the semi spill-proof opening 220 in insert 120, while substantially maintaining its semi spill-proof properties. Likewise, the deformable properties of insert 120 allow it to be removed for cleaning and reinstalled quickly and easily. Likewise, for the same reasons, insert 120 can be replaced if it becomes worn out. Other shapes, sizes, and materials can be used for insert 120 in other embodiments.

Figure 7:
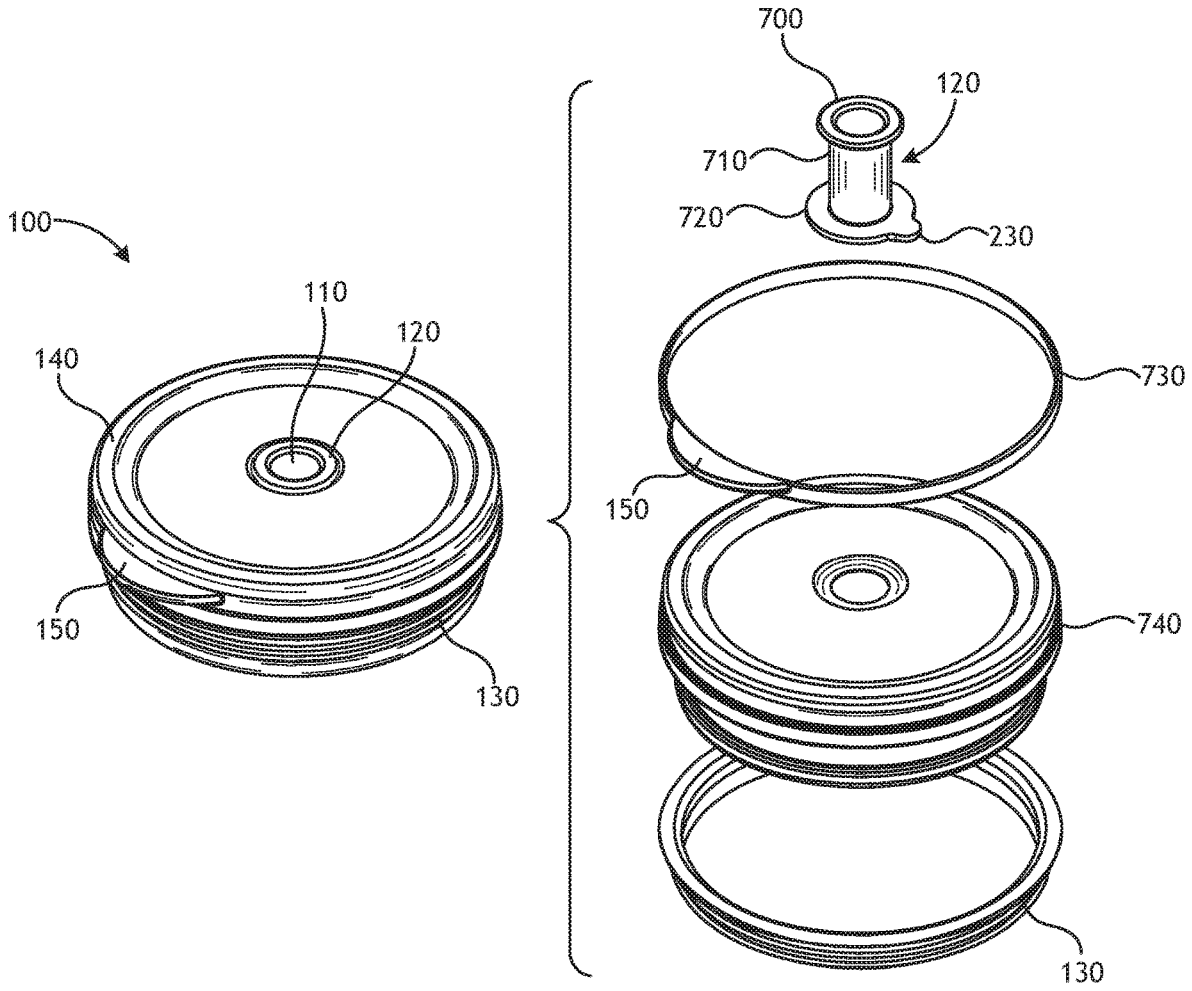
FIG. 7 is an exploded, perspective view diagram of one embodiment of a lid.

FIG. 7 is an exploded, perspective view diagram of an embodiment of a lid 100. In this embodiment, the lid 100 includes features described above with respect to the embodiments of FIGS. 1-6, namely a first opening 110, an insert 120, a seal 130, a rim 140, and a tab 150. The exploded perspective of FIG. 7 illustrates an embodiment of the lid 100 having multiple, separate components. While this embodiment shows several separate components, other embodiments having more, less, or no separate components are possible and within the scope of the present invention.

Specifically, FIG. 7 shows an embodiment of insert 120. Insert 120 is shown as a separate component that can be inserted and removed from lid 100. In this embodiment, insert 120 is made of pliable rubber such that its deformable properties allow it to be installed in and/or removed quickly and easily from the first opening 110 in lid 100. Other properties of this particular embodiment of insert 120 show it including a top lip 700, a hollow body 710, and a bottom lip 720. This shape allows insert 120 to seat in the first opening 110 and to be held in place by conforming to the interior shape of first opening 110 and overlapping the surfaces of the lid 100 immediately adjacent the upper surface of the first opening (at top lip 700) and the lower surfaces of the first opening (at bottom lip 720). Likewise, the hollow center of insert 120 allows a straw or other drinking implement to be readily inserted there-through. Tab 230 on insert 120 allows for better grasping insert 120 when inserting, removing, or cleaning insert 120.

FIG. 7 also shows tab 150. In this particular embodiment, of which others are possible, tab 150 is integral with circular ring 730. Ring 730, and therefore tab 150, is sized so that it can be slipped over and snuggly placed around the body portion 740 of the lid 100. In yet another embodiment, ring 730 will rest in a groove around the circumference of the body portion 740 so that ring 730 remains in place on the body portion 740. In this embodiment, while ring 730 will remain in place on the body portion 740, it is able to rotate in place around the body portion 740.

FIG. 7 also shows seal 130. In this particular embodiment, of which others are possible, seal 130 is sized so that it can be slipped over and snuggly placed around the body portion 740 of the lid 100. In yet another embodiment, the seal 130 will rest in a groove around the circumference of the body portion 740 so that the seal 130 remains in place on the body portion 740. In this embodiment, while the seal 130 will remain in place on the body portion 740, it is able to rotate in place around the body portion 740.

In this particular embodiment, the design of the ring 730 and the seal 130 are such that they can be removed from the lid 100 for cleaning or other replacement.

FIG. 8 is a perspective view of the lid 100 integrated with a vessel 800. Also shown is a straw 810. As shown, the straw 810 is inserted through the first opening 110 (not labeled), as formed by insert 120 (not labeled). Other shapes and sizes of vessel 800 are possible. Likewise, straw 810 is not necessary since liquids in vessel 800 can be consumed through first opening 110 without using straw 810.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A lid for a drinking vessel, comprising:

a top portion and a bottom portion, where the top portion and the bottom portion form an enclosed, vacuum insulated region;

a first opening in the lid, where the first opening extends through the top portion and the bottom portion of the lid but does not expose the enclosed region of the lid to atmospheric conditions; and an insert in the first opening that substantially conforms to the first opening and includes a top lip interfacing the top portion of the lid and a bottom lip interfacing the bottom portion of the lid, wherein the insert further includes a semi spill-proof opening, and wherein the insert is flexible and removable such that when it is removed from the first opening the enclosed region of the lid is not exposed to atmospheric conditions.

2. The lid of claim 1, wherein the insert includes a hollow body extending between the top and bottom lip of the insert and between the top portion and bottom portion of the lid.

3. The lid of claim 2, wherein the semi spill-proof opening in the insert is located proximate the hollow body of the insert.

4. The lid of claim 3, wherein the top portion of the lid includes a raised rim.

5. The lid of claim 4, wherein the lid includes a tab for assisting in removing the lid from a drinking vessel.

6. The lid of claim 5, wherein the bottom portion of the lid includes a raised rim.

7. The lid of claim 6, wherein the insert includes at least one air vent.

8. The lid of claim 7, wherein the insert includes a tab located on the top lip of the insert or on the bottom lip of the insert.

9. The lid of claim 8, wherein the top portion and the bottom portion of the lid are separated from one another by a body portion.

10. The lid of claim 9, wherein the body portion includes a seal.

11. The lid of claim 10, wherein the body portion includes a ring.

12. The lid of claim 11, wherein the ring on the body portion includes the tab for assisting in removing the lid from a drinking vessel.

13. The lid of claim 12, wherein the seal is removable from the lid.

14. The lid of claim 13, wherein the ring is removable from the lid.

15. The lid of claim 14, wherein the air vent is located proximate the semi spill-proof opening on the insert.

* * * * *